US008277518B1

(12) United States Patent
Kramer et al.

(10) Patent No.: US 8,277,518 B1
(45) Date of Patent: Oct. 2, 2012

(54) ECOLOGICAL FABRIC HAVING ULTRAVIOLET RADIATION PROTECTION

(75) Inventors: Robert Kramer, St. Louis, MO (US); Ronald Kramer, St. Louis, MO (US); Nicholas Marshall, Charleston, SC (US)

(73) Assignee: The Sweet Living Group, LLC, St. Louis, MO (US)

( * ) Notice: Subject to any disclaimer, the term of this patent is extended or adjusted under 35 U.S.C. 154(b) by 0 days.

(21) Appl. No.: 13/317,152

(22) Filed: Oct. 11, 2011

(51) Int. Cl.
*D06M 11/00* (2006.01)

(52) U.S. Cl. ..... 8/115.51; 8/116.1; 8/115.54; 442/131

(58) Field of Classification Search ..... 8/115.51
See application file for complete search history.

(56) References Cited

U.S. PATENT DOCUMENTS

| | | | | |
|---|---|---|---|---|
| 6,034,003 | A | 3/2000 | Lee | |
| 6,607,994 | B2 | 8/2003 | Soane et al. | |
| 7,262,160 | B2 | 8/2007 | Black | |
| 7,754,625 | B2 | 7/2010 | Hendriks et al. | |
| 2004/0074012 | A1 | 4/2004 | Heidenfelder et al. | |
| 2005/0175530 | A1 * | 8/2005 | Baglioni et al. | 423/622 |
| 2009/0233507 | A1 | 9/2009 | Gross et al. | |

FOREIGN PATENT DOCUMENTS

| | | | |
|---|---|---|---|
| CN | 101748596 A | * | 6/2010 |
| WO | WO 2010018075 A1 | * | 2/2010 |

OTHER PUBLICATIONS

Lam et al., "Effect of zinc oxide on flame retardant finishing of plasma pre-treated cotton fabric" published online in Cellulose journal on Nov. 19, 2010.*

Yadav et al., "Functional finishing in cotton fabrics using zinc oxide nanoparticles", published in Bulletin of Materials Science Nov. 2006.*

Derwent Abstract Acc-No: 2010-J55398, English abstract for Duan Y et al. CN 101748596 A, Derwent week 201056.*

Blanchard and Graves, Phosphorylation of Cellulose with Some Phosphonic Acid Derivatives, Textile Research Journal, 2003, 73, 22-26.

Fangli et al. Preparation and properties of zinc oxide nanoparticles coated with zinc aluminate, Journal of Materials Chemistry, 2003, 13, 634-637.

Gelest, Inc. "Silane coupling agents: connecting across boundaries." http://www.gelest.com/pdf/couplingagents.pdf, 60 pages, undated but prior to Oct. 11, 2011.

Hau et al. Effect of Chemical Modification of Fluuerene-Based Self-Assembled Monolayers on the Performance of Inverted Polymer Solar Cells. Applied Materials and Interfaces 2010 2(7), 1892-1902.

Lu and Ng, Efficient, One-Step Mechanochemical Process for the Synthesis of ZnO Nanoparticles. Industrial Engineering Chemical Research, 2008, 47, 1095-1101.

Law et al. ZnO-AI203 and ZnO-TiO2 Core-Shell Nanowire Dye-Sensitized Solar Cells, Journal of Physical Chemistry B, 2006, 110(45), 22652-22663.

Perez et al. TEMPO-Mediated Oxidation of Cellulose III. Biomacromolecules, 2003, 4, 1417-1425.

Turgeman et al. Crystallization of Highly Oriented ZnO Microrods on Carboxylic Acid-Terminated SAMs, Chemistry of Materials, 2005, 17(20), 5048-5056.

Zhang et al. Surface Functionalization of Zinc Oxide by Carboxyalkylphosphonic Acid Self-Assembled Monolayers, Langmuir, 2010, 26(6), 4514-4522.

* cited by examiner

*Primary Examiner* — Harold Pyon
*Assistant Examiner* — Katie L Hammer
(74) *Attorney, Agent, or Firm* — David H. Chervitz

(57) ABSTRACT

An ecological fabric having protection from ultraviolet radiation incorporated therein is disclosed in which the fabric is treated by a method comprising the steps of dissolving zinc acetate or other zinc salt in a liquid to form a solution containing Zn(II) ions, adding a fabric to the solution, mixing the solution and the fabric, and adding a base to the solution when the solution and the fabric are being mixed to form a suspension of zinc oxide nanoparticles in contact with the fabric. Other methods are disclosed such as modifying a fabric by carboxylation or phosphorylation of the fabric followed by binding of the UV-blocking nanoparticles to the modified fabric and modifying UV-blocking nanoparticles with a self-assembled monolayer (SAM) or polymer layer containing an active chemical group capable of binding to the fabric and depositing the UV-blocking nanoparticles on the fabric.

14 Claims, No Drawings

ECOLOGICAL FABRIC HAVING ULTRAVIOLET RADIATION PROTECTION

BACKGROUND

This disclosure relates to a fabric having ultraviolet radiation protection, and more specifically, to a ecological fabric having ultraviolet radiation protection incorporated into the fabric.

Ecological friendly fabrics or Eco-friendly fabrics are gaining in popularity and use in clothing. An Eco-friendly fabric may be a natural fiber such as cotton, hemp, or bamboo which has been grown in soil that has not been treated with pesticides for a number of years. Some examples of other Eco-friendly fabrics are organic cotton, sisal, a combination of hemp and recycled rayon, a combination of hemp and cotton, broadcloth, denim, linen, and a combination of bamboo and recycled rayon. Natural fibers, which may be derived from plants or animals, such as wool, angora, silk, alpaca, cashmere, and silk are also examples of Eco-friendly fabrics. Synthetic fabrics, which may be made from synthetic sustainable products, such as nylon, rayon, olefin, spandex, and tencel are also examples of Eco-friendly fabrics.

To assist an individual in determining whether a garment has protection against ultraviolet radiation, a rating system has been developed. This rating system is known in the industry as the UPF (Ultraviolet Protection Factor) rating system. Clothing having a rating of UPF 50 are able to block out 98% of the sun's ultraviolet radiation. Further, by way of example, a garment having a rating of UPF 15-24 will only block out 93.3% to 95.9% of ultraviolet radiation. Exposure to the sun's harmful ultraviolet radiation (known as UVA/UVB rays) can damage the skin, can cause sunburn, and can lead to skin cancer over prolonged exposure.

There are a number of factors that affect the level of ultraviolet radiation protection provided by a fabric and the UPF rating. Some factors are the weave of the fabric, the color of the fabric, the weight of the fabric, the fiber composition of the fabric, the stretch of the fabric, moisture content of the fabric. If the fabric has a tight weave or a high thread count then the fabric will have a higher UPF rating. However, even though the fabric has a higher UPF rating, the fabric may be less comfortable because a tighter weave or higher thread count means that the fabric is heavy or uncomfortable to wear. Another factor that affects protection is the addition of chemicals such as UV absorbers or UV diffusers during the manufacturing process. As can be appreciated, some of the features that make a garment comfortable to wear also make the garment less protective. A challenge for a clothing manufacturer is to provide clothing having both protection from the sun and being comfortable to wear.

Therefore, it would be desirable to have an Eco-friendly fabric that can be treated to protect an individual from the effects of the sun. Moreover, there is a need for a controllable process for attaching UV protection to Eco-friendly fabric so that the treated fabric may be used to protect an individual from UV radiation. Furthermore, it would be advantageous to incorporate adequate protection in a garment, fabric, or textile to protect against exposure to UV radiation, to increase the UV resistance of a garment, fabric, or textile, or to enhance UV radiation absorption of a garment, fabric, or textile to protect an individual from UV radiation.

BRIEF SUMMARY

In one form of the present disclosure, a method for treating a fabric for protection from ultraviolet radiation comprises the steps of dissolving zinc acetate or other zinc salt in a liquid to form a solution containing Zn(II) ions, adding a fabric to the solution, mixing the solution and the fabric, and adding a base to the solution when the solution and the fabric are being mixed to form a suspension of zinc oxide nanoparticles in contact with the fabric.

In another form of the present disclosure, a method for treating a fabric for protection from ultraviolet radiation is disclosed which comprises the steps of placing a fabric into a solution of phosphoric acid or a phosphonic acid derivative to allow for phosphorylation of the fabric to take place, pressing the fabric to remove the solution, heating the fabric, washing the fabric, placing the fabric into a suspension of zinc oxide nanoparticles, mixing the fabric in the suspension of zinc oxide nanoparticles, removing the fabric from the suspension of zinc oxide nanoparticles, and drying the fabric to force surface condensation.

In yet another form of the present disclosure, a method for treating a fabric for protection from ultraviolet radiation comprises the steps of suspending zinc oxide nanoparticles in a mixture of an aqueous buffer, and an organosilane or phosphonate with a reactive group, collecting the zinc oxide nanoparticles by centrifugation, washing the collected zinc oxide nanoparticles, re-suspending the zinc oxide nanoparticles in a buffer, and placing a fabric into the zinc oxide nanoparticles in the buffer.

The present disclosure provides an ecological fabric having ultraviolet radiation protection which is lightweight and can be worn in any temperature.

The present disclosure provides an ecological fabric having ultraviolet radiation protection which provides enhanced protection from both UVA and UVB radiation when worn by an individual.

The present disclosure also provides an ecological fabric having ultraviolet radiation protection which retains ultraviolet radiation protection after use or after cleaning.

The present disclosure provides an ecological fabric having ultraviolet radiation protection which is comfortable to wear.

The present disclosure also provides an ecological fabric having ultraviolet radiation protection which can be manufactured without increasing the cost of the fabric.

DETAILED DESCRIPTION OF PREFERRED EMBODIMENTS

Various methods or processes are disclosed herein for the immobilization of UV-blocking nanoparticles on Eco-friendly fabric to incorporate UV protection in the fabric. Once the UV-blocking nanoparticles are attached, the Eco-friendly fabric will be able to protect a wearer of the fabric from UV radiation. One method comprises direct immobilization from in situ formation of the particles. A second method comprises carboxylation or phosphorylation of the fabric followed by binding of the UV-blocking nanoparticles to the modified fabric. A third method comprises modifying UV-blocking nanoparticles with a self-assembled monolayer (SAM) or polymer layer containing an active chemical group capable of binding to the fabric and deposited on the fabric from solution.

ZnO (zinc oxide) nanoparticles are generally formed by the precipitation of a zinc salt (acetate, sulfate, nitrate, chloride) using either aqueous hydroxide or an amine. The following examples disclose direct immobilization from in situ formation of the ZnO nanoparticles.

Example 1

Solution Sol-Gel Process, Hydroxide Base 4.39 g. zinc acetate (20 mmol) is dissolved in 100 mL deionized or distilled water. A textile is added to this solution and 100 mL 0.4M NaOH is added while mixing. The suspension is mixed for 2 hours to form a suspension of zinc oxide nanoparticles in contact with the fabric. The textile is removed from the nanoparticle suspension and laundered in a household washing machine. As can be appreciated, a fabric may be treated to have ultraviolet radiation protection incorporated in the fabric by the steps of dissolving zinc acetate or other zinc salt in a liquid to form a solution containing Zn(II) ions, adding a fabric to the solution, mixing the solution and the fabric, and adding a base to the solution when the solution and the fabric are being mixed to form a suspension of zinc oxide nanoparticles in contact with the fabric.

Example 2

Solution Sol-Gel Process, Amine Base 4.39 g. zine acetate (20 mmol) is dissolved in 100 mL deionized water. A textile is added to this solution while mixing and 40 mmol amine is added while mixing. Amines used may include ethanolamine, ethylenediamine, (tris)hydroxymethylaminomethane, or others. The textile is removed from the nanoparticle suspension and laundered in a household washing machine.

Example 3

Mechanochemical Process 5.75 g. zinc sulfate heptahydrate (20 mmol) and 0.88 g (15 mmol) sodium chloride are powered finely and blended, then placed with a textile in a ball mill or similar mechanical mixer. 1.6 g (40 mmol) sodium hydroxide is powered and added to the mixer. After twenty minutes, the textile is removed and rinsed thoroughly with water.

The following examples disclose carboxylation or phosphorylation of the fabric followed by binding of the UV-blocking nanoparticles to the modified fabric.

Example 4

Modification of Textile with Phosphonic Acid Groups

For this process it will be necessary to modify a textile with phosphonic acid groups. This can be accomplished in a number of ways, but it is desirable to use materials that are non-toxic and/or renewably sourced chemicals. Phosphorylated cellulose should form covalent linkages with ZnO and $TiO_2$ nanoparticles. The interaction between phosphonates and oxide surfaces are used for modification of the oxide surfaces. In essence, the procedure consists of condensing the cellulose textile with a bis(phosphonic acid), phosphonate, or phosphate species, either organic or inorganic. Urea may be added to forestall discoloration of the textile. Phosphorylation takes place driven by the elimination of water. The resulting phosphorylated textile will directly bind both zinc oxide and titanium oxide nanoparticles. It will be necessary to restrict the degree of phosphorylation of the textile to prevent great alteration in the properties of the textile by controlling a reaction time. This process does not require in situ synthesis of the zinc oxide nanoparticles. Commercially available zinc oxide nanoparticles may be used.

A sample of cotton textile is wetted with a 10% v/v solution of phosphoric acid or bis-phosphonic acid containing 10-30% w/v urea. The textile is pressed to remove excess solution and baked in an oven at 85-100° C. for 5 minutes to dry, then at 170° C. for 2-4 minutes to cure unreacted groups. The textile is removed from the oven and washed with water. The textile is then used without further modification in subsequent deposition steps.

Example 5

Modification of a Textile by Partial TEMPO—$H_2O_2$ Oxidation

A sample of cotton textile (ca. 1 g) is added to a solution composed of 90 mL water with 10 mg (0.065 mmol) TEMPO and 0.22 g (2 mmol) sodium bromide. Hydrogen peroxide 3% is added (0.9 mL, 1 mmol) and the reaction stirred at RT for 10 minutes to 2 hours. The material is washed with water, dried, and used without further modification in the following ZnO deposition step.

Example 6

Immobilization of Nanoparticles on a Phosphorylated or Carboxylated Cellulose Surface Ca. 1 mg/mL nanoparticles are suspended in water, ethyl alcohol, or other solvent. The phosphorylated or carboxylated cellulose textile is added to the suspension and the suspension is gently mixed over a reaction period of 1 to 12 hours. The textile is removed from the suspension and subjected to tumble drying or another drying procedure to force surface condensation and cure remaining groups.

The following example discloses modifying UV-blocking nanoparticles with a self-assembled monolayer (SAM) or polymer layer containing an active chemical group capable of binding to the fabric and deposited on the fabric from solution.

Example 7

Grafting to Attachment of Cellulose to Nanoparticles Through Reactive Groups

In this method, ZnO particles are synthesized separately by any of the means discussed in Examples 1-3 or the ZnO particles may be purchased commercially. The ZnO particles are suspended in water or a weak non-nucleophilic aqueous buffer and an organosilane or phosphonate with one of the given combinations of reactive groups, as shown in Table 1, is added. Multidentate ligand or polymeric silanes may also be added to this mixture to facilitate the formation of a durable reactive layer and an oxide, alkoxide, or salt of another metal such as Ti or Si may be added first to form a surface layer of another oxide in the ZnO particles. After a reaction time of 1 to 12 hours, the particles are collected by centrifugation and washed with water. The particles are then resuspended in water or buffer and added to the textile. The conditions for binding of the particles to the textile vary depending on the headgroup, as shown in Table 1, but may involve direct application of the particles to the textile similarly to the process disclosed in Example 6, raising the pH of the suspension containing the textile, or heating the textile either in or after removal from the suspension. This process has the advantage of yielding extremely fine control over the nature of the linkage between particle and textile. This process has a further advantage in that the treated textile will be durable due to the robustness of self-assembled siloxane layers on oxide.

TABLE 1

| Molecule name (if commercially available) | Linker | Headgroup | Commercially available? |
|---|---|---|---|
| 3-glycidoxypropyl-triethoxysilane | Triethoxy-silane | Glycidyl ether | Yes |
| 2-(3,4-cyclohexyloxy) ethyltriethoxysilane | Triethoxy-silane | Cyclohexyl oxide | Yes |
| Hydroxymethyl-triethoxysilane | Triethoxy-silane | Hydroxymethyl | Yes |
| Isocyanatopropyl trimethoxysilane | Trimethoxy-silane | Isocyanate | Yes |
| Bis(triethoxysilyl) ethane | Triethoxy-silane (2) | N/A | Yes |
| 6-azidosulfonylhexyl triethoxysilane | Triethoxy-silane | Axidosulfonyl | Yes |
| | Triethoxy-silane | Vinylsulfone | No |
| | Triethoxy-silane | Aryl azide | No |
| | Phosphonate | Glycidyl ether | No |
| | Phosphonate | Cyclohexyl oxide | No |
| | Phosphonate | Azidosulfonyl | No |
| | Phosphonate | Vinylsulfone | No |
| | Phosphonate | Aryl azide | No |
| Bis(triethoxysilyl) propylamine | Triethoxy-silane (2) | Secondary amine | Yes |
| APTES/EGDE | Triethoxy-silane | Amine/Ethylene glycol diglycidyl ether | Yes, 2 components |

The terms "fabric" or "textile" are intended to include fibers, filaments, yarn, textiles, material, woven and non-woven fabric, knits, and finished products such as garments. The methods described above may be used in treating fibers, filaments, yarn, textiles, and fabrics. For example, fibers may be initially treated by use of one or more of the above disclosed methods and the fibers may be manufactured into a fabric or a textile. Once manufactured into a fabric, the fabric may be treated by use of one or more of the disclosed methods. In this manner, individual fibers and the entire fabric are treated to incorporate UV protection. As can be appreciated, the treated fabric may be used to manufacture a garment such as, by way of example only, shirts, pants, hats, coats, jackets, shoes, socks, uniforms, athletic clothing, and swimwear. It is also possible and contemplated that the treated fabric may be used to construct non-apparel items such as blankets, sheets, sleeping bags, backpacks, and tents.

Further, it is also possible to further modify ZnO particles with a thin layer of other oxides in a "core-shell" type procedure by adding a reactive precursor to a suspension of the ZnO oxides. Oxides that can be deposited in this manner include $SiO_2$ from tetraethoxysilane (TEOS) or sodium silicate, and $Al_2O_3$ and $TiO_2$ either from the appropriate alkoxides, aluminate/titanate compounds, or other hydrolyzable aluminum or titanium compounds. A second oxide shell of this type may enhance the formation and stability of both directly applied ZnO-textile conjugates and those formed by modification of nanoparticles with an organic monolayer. ZnO can also be modified by the addition of a multidentate silane along with a silane containing the desired functional group. The multidentate silane yields a more densely crosslinked siloxane surface than monodentate silances alone, forming a more stable layer on ZnO.

From all that has been said, it will be clear that there has thus been shown and described herein an ecological fabric having ultraviolet radiation protection incorporated into the fabric which fulfills the various advantages sought therefore. It will become apparent to those skilled in the art, however, that many changes, modifications, variations, and other uses and applications of the subject ecological fabric having ultraviolet radiation protection incorporated into the fabric are possible and contemplated. All changes, modifications, variations, and other uses and applications which do not depart from the spirit and scope of the disclosure are deemed to be covered by the disclosure, which is limited only by the claims which follow.

What is claimed is:

1. A method for treating a fabric for protection from ultraviolet radiation consisting of the steps in sequence of:
- dissolving zinc salt in a liquid to form a solution containing Zn(II) ions;
- adding a fabric to the solution;
- mixing the solution and the fabric; and
- adding a base to the solution when the solution and the fabric are being mixed to form a suspension of zinc oxide nanoparticles in contact with the fabric.

2. The method of claim 1 further consisting of the steps of removing the fabric from the solution of zinc oxide nanoparticles and washing the fabric.

3. The method of claim 1 wherein the base is NaOH.

4. The method of claim 1 wherein the base is an amine.

5. The method of claim 1 wherein the liquid is deionized water.

6. The method of claim 1 wherein the solution, the fabric, and the base are mixed for two hours.

7. The method of claim 1 wherein the fabric is cotton.

8. The method of claim 1 wherein the fabric is an organic cotton.

9. A method for treating a fabric for protection from ultraviolet radiation comprising the steps of:
- placing a fabric into a solution of phosphoric acid or a phosphonic acid derivative to allow for phosphorylation of the fabric to take place;
- pressing the fabric to remove the solution;
- heating the fabric;
- washing the fabric;
- placing the fabric into a suspension of zinc oxide nanoparticles;
- mixing the fabric in the suspension of zinc oxide nanoparticles;
- removing the fabric from the suspension of zinc oxide nanoparticles; and
- drying the fabric to force surface condensation.

10. The method of claim 9 wherein the solution of phosphoric acid further comprises 10-30% w/v urea.

11. The method of claim 9 wherein the heating step comprises baking the fabric in an oven at 85-100° C. for five minutes then at 170° C. for two to four minutes.

12. The method of claim 9 wherein the washing step comprises using water.

13. The method of claim 9 wherein the fabric is cotton.

14. The method of claim 9 wherein the fabric is an organic cotton.

* * * * *